US007802320B2

(12) United States Patent
Morgan

(10) Patent No.: US 7,802,320 B2
(45) Date of Patent: Sep. 28, 2010

(54) HELMET PADDING

(76) Inventor: Don E. Morgan, 33 Kingsley Pde Yeronga, Brisbane, Queensland (AU) 4104

( * ) Notice: Subject to any disclaimer, the term of this patent is extended or adjusted under 35 U.S.C. 154(b) by 847 days.

(21) Appl. No.: 11/169,635

(22) Filed: Jun. 30, 2005

(65) Prior Publication Data

US 2007/0000032 A1 Jan. 4, 2007

(51) Int. Cl.
*A42B 3/00* (2006.01)

(52) U.S. Cl. ..... 2/414; 2/411; 2/412

(58) Field of Classification Search ..... 2/410, 2/411, 412, 414
See application file for complete search history.

(56) References Cited

U.S. PATENT DOCUMENTS

| | | | | | |
|---|---|---|---|---|---|
| 3,425,061 | A * | 2/1969 | Webb | 2/414 |
| 4,307,471 | A * | 12/1981 | Lovell | 2/411 |
| 4,586,200 | A * | 5/1986 | Poon | 2/413 |
| 5,309,576 | A * | 5/1994 | Broersma | 2/412 |
| 5,511,260 | A * | 4/1996 | Dinsmoor et al. | 5/676 |
| 5,669,079 | A | 9/1997 | Morgan | |
| 5,950,244 | A * | 9/1999 | Fournier et al. | 2/414 |
| 6,070,271 | A | 6/2000 | Williams | |
| 6,070,905 | A | 6/2000 | Renault | |
| 6,216,268 | B1 * | 4/2001 | Schleicher | 2/16 |
| 6,240,570 | B1 * | 6/2001 | Wu | 2/410 |
| 6,453,476 | B1 * | 9/2002 | Moore, III | 2/412 |
| D521,191 | S | 5/2006 | Berger | |
| 2001/0032351 | A1 * | 10/2001 | Nakayama et al. | 2/412 |
| 2003/0005511 | A1 * | 1/2003 | Tao et al. | 2/411 |
| 2005/0246824 | A1 | 11/2005 | Berger et al. | |
| 2007/0000032 | A1 * | 1/2007 | Morgan | 2/412 |

FOREIGN PATENT DOCUMENTS

| | | |
|---|---|---|
| JP | 10-29470 | 2/1998 |

* cited by examiner

*Primary Examiner*—Shaun R Hurley
*Assistant Examiner*—Andrew W Sutton
(74) *Attorney, Agent, or Firm*—Gordon & Jacobson, PC

(57) ABSTRACT

An improved helmet padding includes a multi-layered liner including an innermost layer consisting of a comfort liner designed to engage the head of the user, and having an outer surface covered by an inner surface of a relatively low density foam layer. The relatively low density foam layer consists of a first region of relatively uniform thickness with an outer area from which a multiplicity of protuberances extend radially outwardly. The radially outward layer of the inventive padding consists of a layer of relatively high density foam. The outer layer includes a plurality of recesses corresponding to the protuberances of the inner layer and sized to snugly receive the conical protuberances therewithin. The outer surface of the outer foam layer is shaped and configured to engage the outer shell of a helmet in which it is installed.

27 Claims, 5 Drawing Sheets

HELMET PADDING

BACKGROUND OF THE INVENTION

The present invention relates to improved helmet padding. Applicant incorporates by reference Applicant's prior U.S. Pat. No. 5,669,079 issued on Sep. 23, 1997. In Applicant's prior U.S. patent, the invention disclosed consists of a layer of high density foam in which low density foam plugs were embedded. In one embodiment, the plugs consist of cylindrical plugs, whereas in a second embodiment, the plugs consist of generally conical plugs having generally rectangular bases. In the latter case, the taper of the plugs extends from a wider portion at the outer periphery to a narrower pointed end in the direction of the inner periphery, but spaced therefrom. In each case, the plugs consist of individual plugs unconnected together by any structure. The present invention differs from the teachings of Applicant's prior patent as contemplating an inner layer of low density foam having integrally formed therewith a plurality of conical portions that taper from a wider portion remote from an outer higher density layer to a pointed termination closer to an outer periphery of the outer high density foam layer.

Subsequent to issuance of Applicant's prior patent, Applicant was co-author of a study titled "Improved Shock Absorbing Liner for Helmets." This publication was published in July, 2001. In the publication, the combination of low density foam embedded into high density foam was disclosed as one subject of the study. However, the study did not contemplate or discuss the combination of structural elements disclosed herein, namely, the combination of a relatively high density outer layer and a relatively low density inner layer, in which the inner layer includes a plurality of generally conical protuberances embedded within the outer layer and with their pointed ends extending toward an outer periphery of the outer higher density foam layer.

The following prior art is known to Applicant:

U.S. Pat. No. 3,529,306 to Thorne teaches an equalizer device consisting of a plurality of plungers that may be wedge shaped with their wider portions toward the outer shell and their narrower portions toward the head of the user. The present invention differs from the teachings of Thorne as contemplating an outer relatively denser foam layer and an inner relatively less dense foam layer with the inner layer having a plurality of generally conical portions embedded within the outer layer with their pointed ends extending toward an outer periphery of the outer layer.

U.S. Pat. No. 3,877,076 to Summers et al. teaches a safety hat energy absorbing liner in which shock absorbing members may be made in a conical shape tapering to a narrower portion adjacent an outer shell. The present invention differs from the teachings of Summers et al. as contemplating an outer relatively denser foam layer and an inner relatively less dense foam layer with the inner layer having a plurality of generally conical portions embedded within the outer layer with their pointed ends extending toward an outer periphery of the outer layer.

U.S. Pat. No. 4,064,565 to Griffiths discloses a helmet structure including a layer filled with spheres, with the spheres being fillable with a liquid. This layer may be located between an incompressible inner layer and a foam outer layer. The present invention differs from the teachings of Griffiths as contemplating the stiffer layer being more remote from the head of the user.

U.S. Pat. No. 4,239,106 to Aileo teaches a helmet made up of an inner layer of padding including a plurality of foam plugs with cushions near the head of the user. The present invention differs from the teachings of Aileo as contemplating embedding of lower density conical plugs within a relatively higher density outer foam layer.

U.S. Pat. No. 4,432,099 to Grick et al. teaches a multi-layered helmet liner including a fabric inner lining followed, radially outwardly, by a plurality of hollow spherical protuberances and an outer energy absorbing foam liner. The present invention differs from the teachings of Grick et al. as contemplating an outer relatively denser foam layer and an inner relatively less dense foam layer with the inner layer having a plurality of generally conical portions embedded within the outer layer with their pointed ends extending toward an outer periphery of the outer layer.

U.S. Pat. No. 4,534,068 to Mitchell et al. discloses a shock attenuation system including an inner layer and a plurality of plugs separating the inner layer from a hard helmet. The present invention differs from the teachings of Mitchell et al. as contemplating an outer relatively denser foam layer and an inner relatively less dense foam layer with the inner layer having a plurality of generally conical portions embedded within the outer layer with their pointed ends extending toward an outer periphery of the outer layer.

U.S. Pat. No. 4,586,200 to Poon discloses a protective crash helmet including an inner layer followed by a layer of air bubbles and an outer cushioning layer. The present invention differs from the teachings of Poon as contemplating an outer relatively denser foam layer and an inner relatively less dense foam layer with the inner layer having a plurality of generally conical portions embedded within the outer layer with their pointed ends extending toward an outer periphery of the outer layer.

U.S. Pat. No. 4,766,614 to Cantwell et al. teaches a ventilated protective head gear including an outer shell and a plurality of elastomeric members that are frustoconical and taper to smaller dimensions in the direction toward the user's head. The present invention differs from the teachings of Cantwell et al. as contemplating an outer relatively denser foam layer and an inner relatively less dense foam layer with the inner layer having a plurality of generally conical portions embedded within the outer layer with their pointed ends extending toward an outer periphery of the outer layer.

U.S. Pat. No. 4,972,527 to Wallace discloses a safety helmet including padding in the nature of a plurality of fins. The present invention differs from the teachings of Wallace as contemplating an outer relatively denser foam layer and an inner relatively less dense foam layer with the inner layer having a plurality of generally conical portions embedded within the outer layer with their pointed ends extending toward an outer periphery of the outer layer.

U.S. Pat. No. 5,309,576 to Broersma discloses a multiple density helmet body composition including the use of wedge shaped padded portions embedded within a molded matrix material. The present invention differs from the teachings of Broersma as contemplating an inner relatively low density padded layer having integrally formed therewith a plurality of conical members that taper to smaller dimensions in the direction of the outer periphery of an outer layer.

In studying prior art configurations of padding for helmets of varying areas of utility, Applicant has found that embedding an inner layer of low density foam within an outer layer of higher density foam is an advantageous configuration. Applicant has also found that it is advantageous to employ a plurality of protuberances extending radially outwardly from the inner layer and interconnected together via the inner layer.

SUMMARY OF THE INVENTION

The present invention relates to an improved helmet padding. The present invention includes the following interrelated objects, aspects and features:

(1) In a first aspect, the present invention contemplates an improved helmet padding in the form of a multi-layered liner. Considering the multi-layered liner from its innermost surface to its outermost surface, the innermost layer consists of a comfort liner designed to engage the head of the user on an inner surface thereof, and having an outer surface covered by an inner surface of a relatively low density foam layer.

(2) The relatively low density foam layer consists of a first region of relatively uniform thickness with an outer area from which a multiplicity of protuberances extend radially outwardly. In the preferred embodiment of the present invention, these protuberances consist of conical elements integrally formed with the relatively low density layer.

(3) Each conical element includes a relatively thicker portion tapering to a pointed end remote from the comfort liner. In the preferred embodiment, the relatively lower density layer has a density in the range of 25-50 kg/m$^3$. Given the conversion rate of 2.2 pounds per kilogram and 35.314 cubic feet per cubic meter, this translates to 1.56 to 3.12 pounds per cubic foot.

(4) The radially outward layer of the inventive padding consists of a layer of relatively high density foam. The outer layer includes an inner surface having a plurality of conical recesses corresponding to the conical protuberances of the inner layer and sized to snugly receive the conical protuberances therewithin. The higher density foam layer, preferably, has a density in the range of 60 to 90 kg/m$^3$. Using the conversion factors set forth above, this translates to 3.74 to 5.62 pounds per cubic foot.

(5) In the preferred embodiment of the present invention, each of the conical protuberances has a generally circular base. However, the base may, if desired, be square or assume any other polygonal shape. The conical protuberances are adjacent to one another and, for example, can have a width of about 20 millimeters and a height of approximately 20 to 25 millimeters. In the preferred embodiment, the pointed outer terminations of the protuberances are spaced 1 to 5 millimeters from the outer surface of the outer foam layer. However, if desired, the pointed terminations of the protuberances may extend contiguous with the outer surface of the outer layer. The peripheries of the bases of adjacent protuberances may be spaced apart by about 0.5 to 2 millimeters.

(6) The outer surface of the outer foam layer is shaped and configured to engage the outer shell of a helmet in which it is installed. The inventive padding may be fastened within the shell using any suitable means including adhesive or mechanical fasteners made of any desired materials such as rubber, plastic or metal.

As such, it is a first object of the present invention to provide an improved helmet padding.

It is a further object of the present invention to provide such a padding including an inner relatively lower density layer and an outer relatively higher density layer.

It is a further object of the present invention to provide such a padding in which the inner layer includes, integrally formed therewith, a plurality of protuberances extending radially outwardly and embedded in the outer layer.

It is a still further object of the present invention to provide such a padding in which the protuberances are generally conically shaped.

It is a still further object of the present invention to provide such a padding in which the pointed ends of the protuberances are spaced from an outer surface of the outer padded layer.

It is a still further object of the present invention to provide such a padding in which in a further embodiment thereof, the pointed ends of the protuberances extend contiguous to the location of the outer surface of the outer foam layer.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
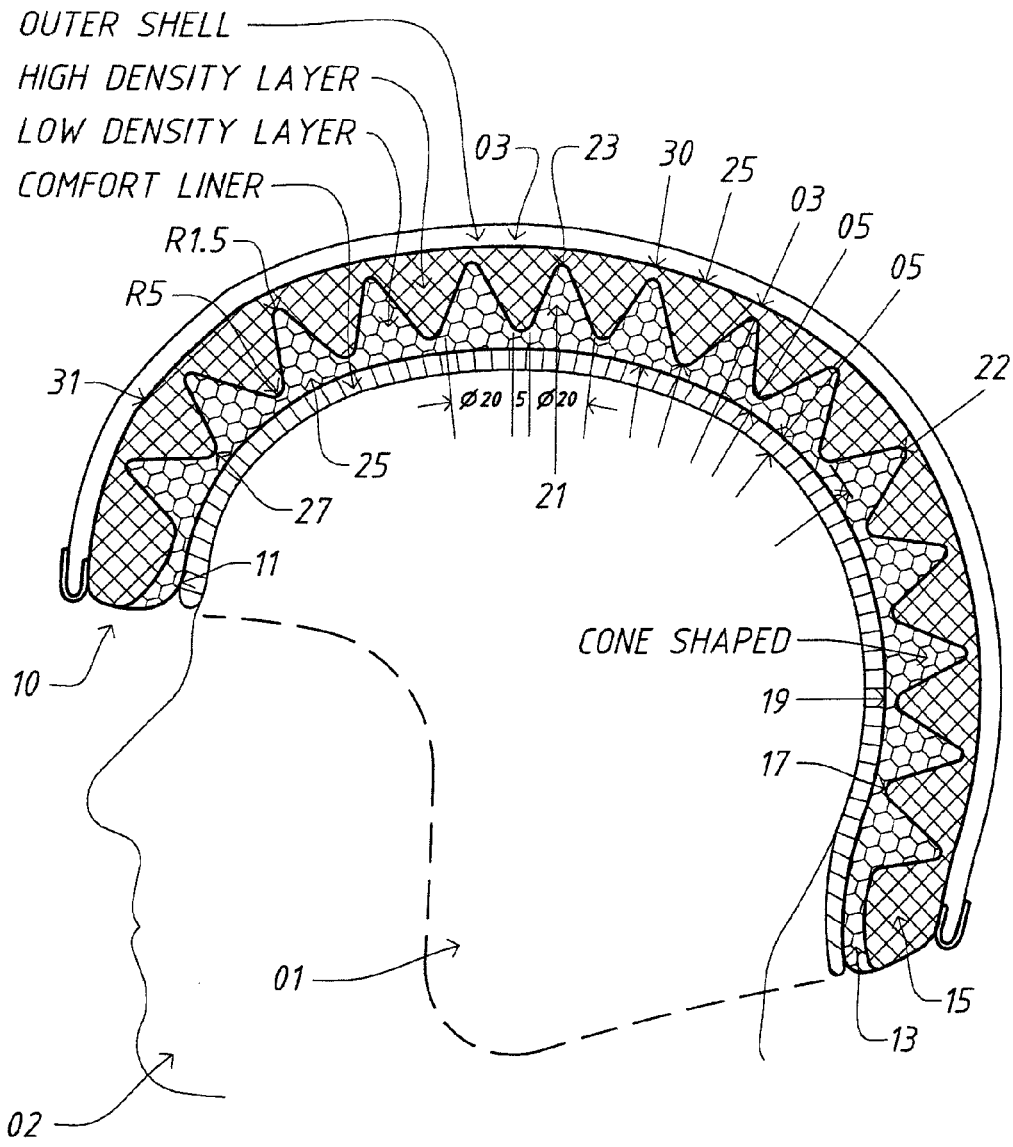
FIG. 1 shows a cross-section of a helmet having the inventive padding installed therein.
Figure 3:
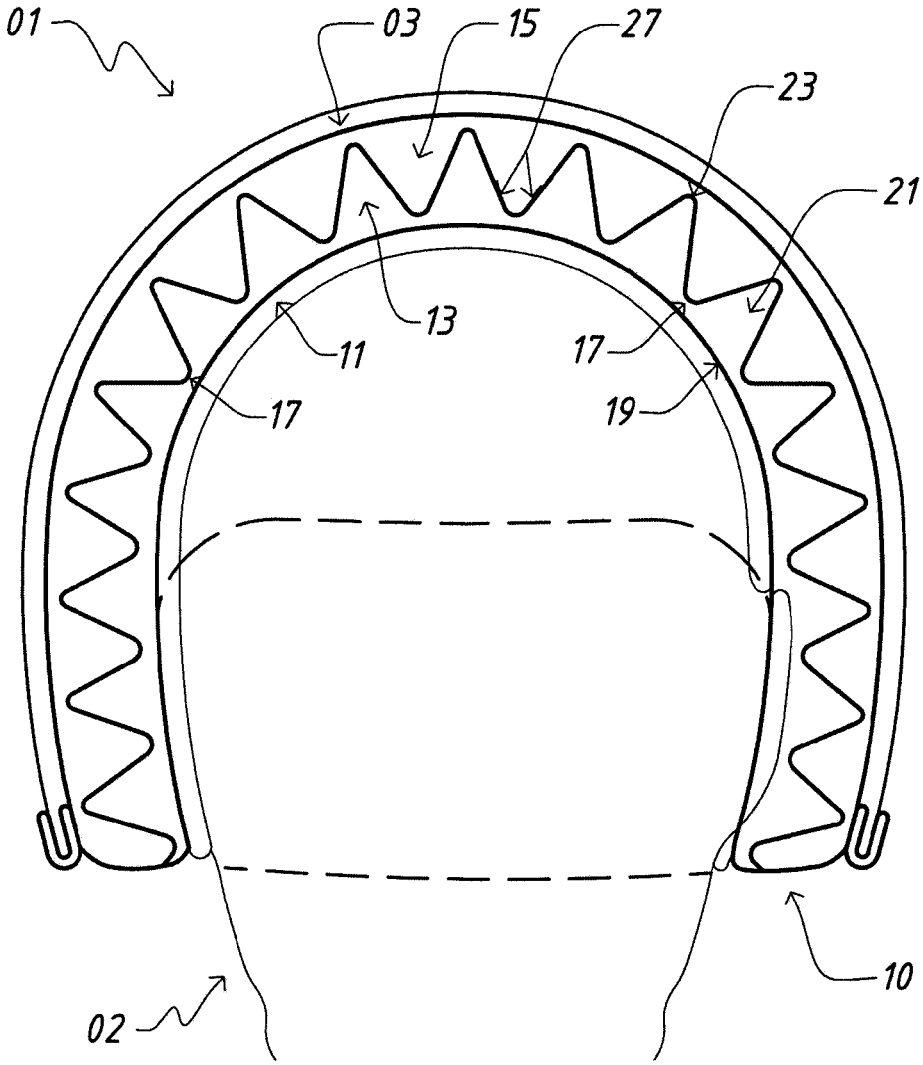
FIG. 3 shows a front view partially in cross-section of a helmet with the inventive padding mounted therein.

Reference is first made to FIGS. 1 and 3 which show a helmet 1 worn by a person 2, with the helmet 1 including a hard outer shell 3. The present invention is generally designated by the reference numeral 10, and is seen to include a comfort liner 11, an inner relatively low density foam layer 13, and an outer relatively high density foam layer 15.

As shown in FIGS. 1 and 3, the inner layer has a first region 17 of relatively uniform thickness and having an inner surface 19 that engages the comfort liner 11. Extending radially outwardly from the region 17 is an outer surface with a multiplicity of conical protuberances 21 integrally formed with the inner layer. The protuberances 21 have pointed ends 23 as well as bases 25 having outer peripheries 27 closely spaced from adjacent protuberances. For example, the spacing between adjacent bases 25 can be as little as ½ millimeter or as much as 5 millimeters. The protuberances 21 cover virtually the entirety of the radially outward portion of the inner layer 13.

Figure 4:
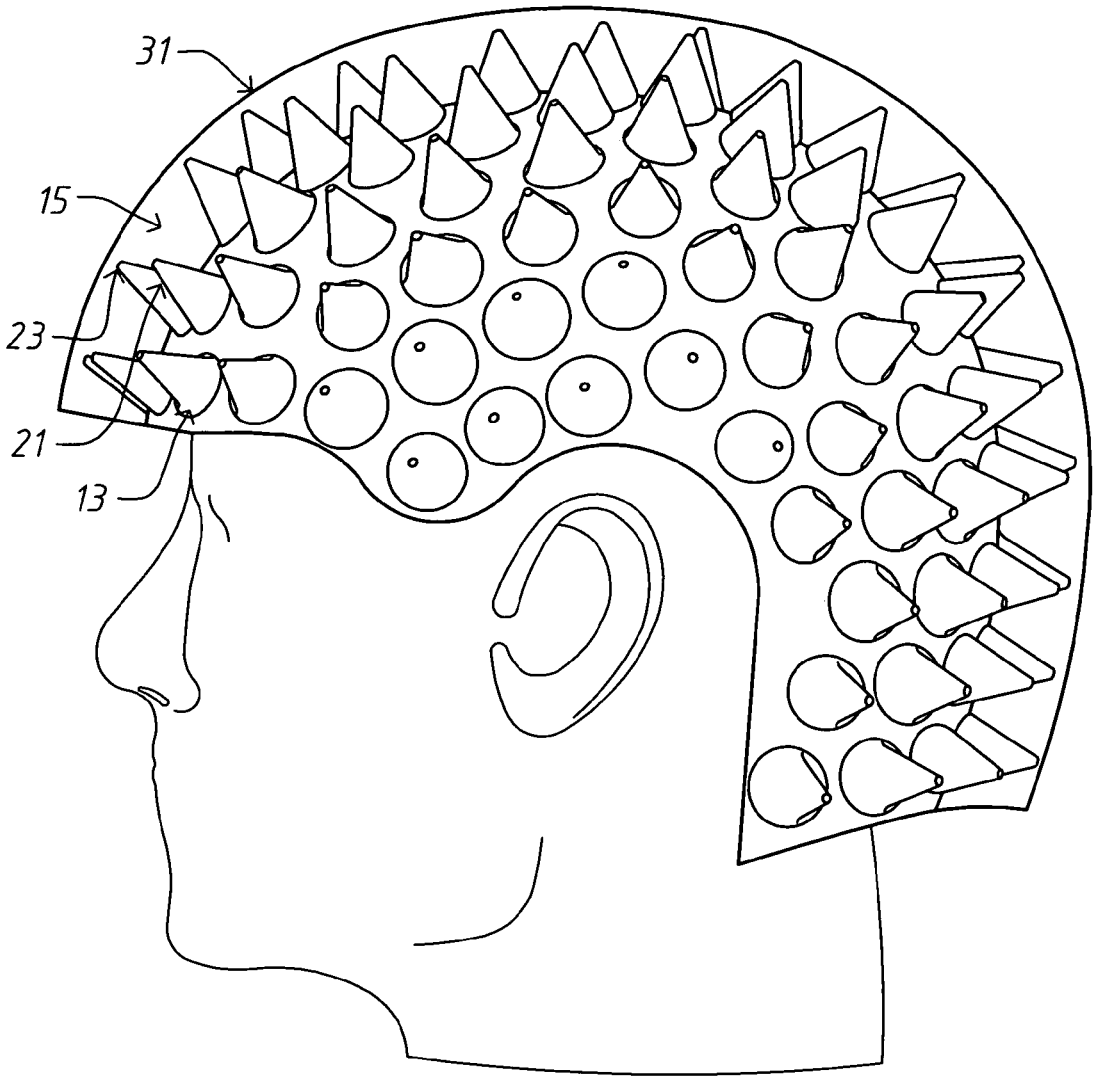
FIG. 4 shows a side view of the inventive padding.
Figure 5:
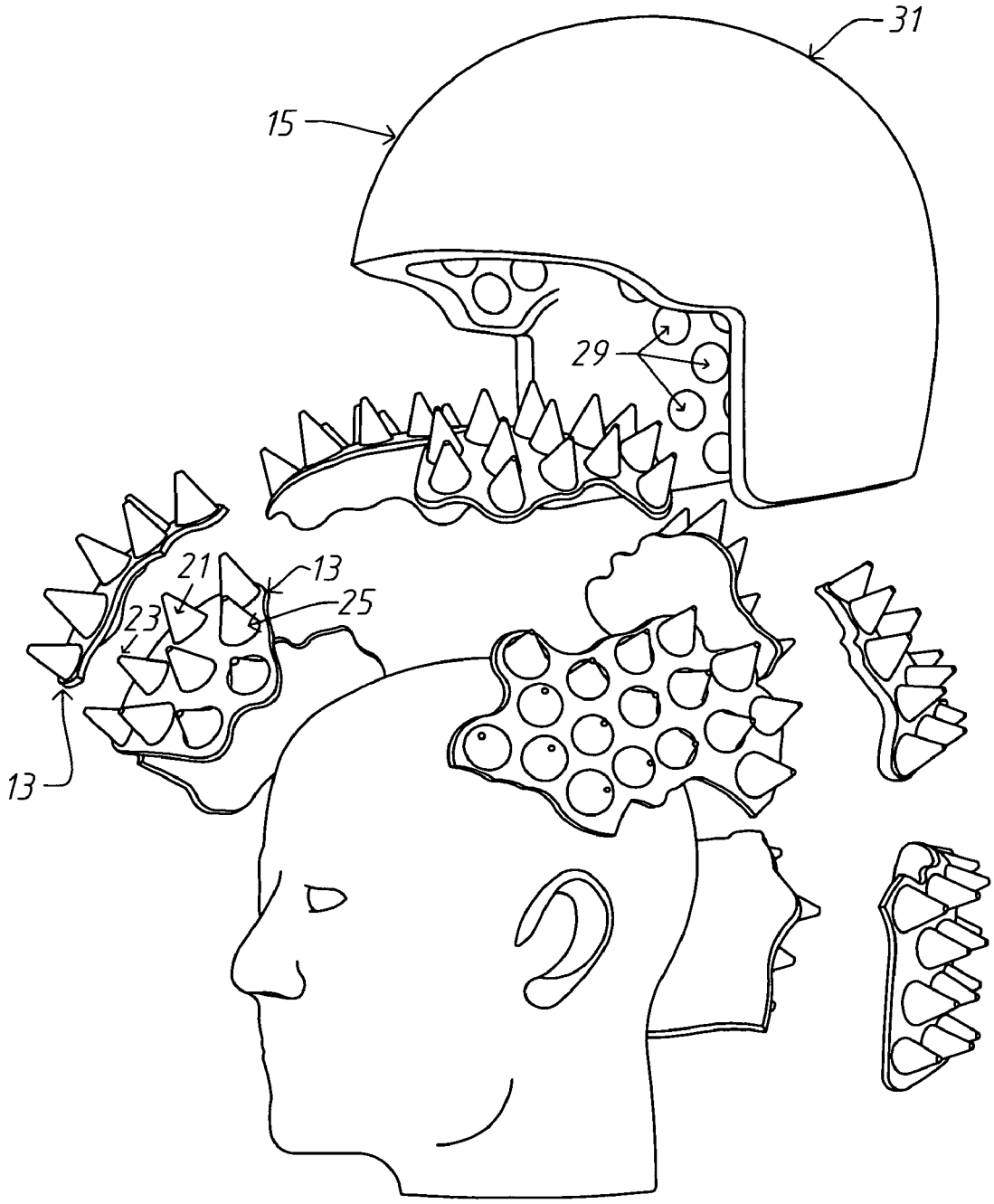
FIG. 5 shows a further side view rotated from the view of FIG. 4 and with the inventive padding exploded to show detail.

With particular reference to FIG. 5, it is seen that the outer layer 15 includes a multiplicity of conical recesses 29 sized and configured to receive the protuberances 25 with surface contact in the manner shown in FIG. 1 as well as in FIG. 4.

Figure 2B:
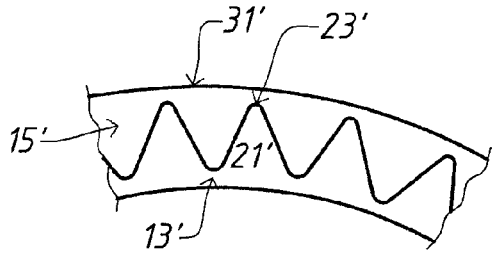
FIGS. 2A and 2B show an alternative construction of the foam layers of the inventive padding.
Figure 2A:
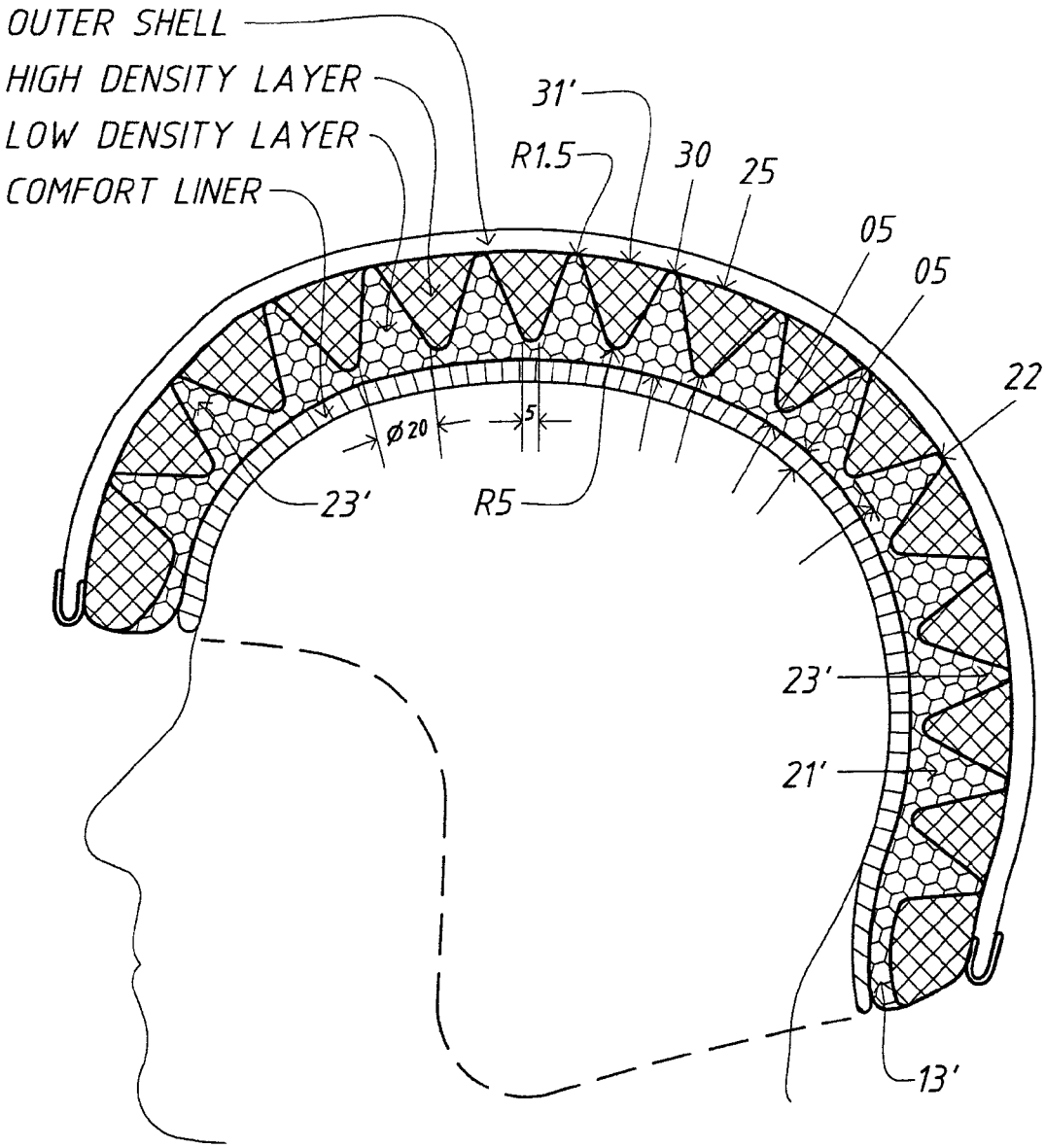

In the preferred embodiment of the present invention, the outer layer 15 includes an outer surface 31 (FIGS. 1 and 5). As particularly shown in FIGS. 1 and 4, in the preferred embodiment, the pointed ends 23 of the protuberances 21 are spaced from the outer surface 31 of the outer layer 15. The spacing may be in the range of 1 to 5 millimeters. However, if desired, in an alternative embodiment with reference to FIG. 2B, the pointed ends 23' of the protuberances 21 of the inner layer 13' may extend to be contiguous with the outer surface 31' of the outer layer 15' as seen in FIG. 2A.

With reference back to FIGS. 1, 4 and 5, in the preferred embodiment, the protuberances 21 have a height of approximately 20 to 25 millimeters and a width of approximately 18 to 22 millimeters. In the preferred embodiment, the inner layer 13 has a density of in the range of 25 to 50 kg/m$^3$, or 1.56 to 3.12 pounds per cubic foot. In the preferred embodiment of the present invention, the outer layer 15 has a density of in the range of 60 to 90 kg/m$^3$ or 3.74 to 5.62 pounds per cubic foot. In accordance with the teachings of the present invention, the foam employed may be of any suitable type that permits densities in the disclosed ranges to be achieved. One example of such a foam consists of polystyrene foam.

If desired, the protuberances 21 can consist of cones having circular bases. If desired, however, the cones can have bases that are polygonal in configuration, for example, square, pentagonal, hexagonal, octagonal, etc. Also, if desired, the protuberances 21 may be made frustoconical rather than conical with pointed terminations.

The inventive padding may be employed with any desired helmet, including motorcycle helmets as well as helmets used by construction personnel and riders of bicycles.

As such, an invention has been disclosed in terms of preferred embodiments thereof, which fulfill each and every one of the objects of the invention as set forth hereinabove, and provide a new and useful improved helmet padding of great novelty and utility.

Of course, various changes, modifications and alterations in the teaching of the present invention may be contemplated by those of ordinary skill in the art without departing from the intended spirit and scope thereof.

As such, it is intended that the present invention only be limited by the terms of the appended claims.

The invention claimed is:

1. An improved helmet padding for engagement within the outer shell of a helmet, the helmet padding comprising:

an inner layer of foam padding and an outer layer of foam padding, the inner layer of foam padding including an inner surface and an outer surface, said outer surface of said inner layer defining a plurality of integrally formed conical protuberances, said inner layer of foam padding having a density relatively lower than density of said outer foam layer, said outer layer of foam padding including an inner surface and an outer surface, said inner surface of said outer layer defining a plurality of conical recesses, each of said conical recesses sized to receive, with surface contact, one of said conical protuberances; and said inner and outer layers being assembled together with said outer surface of said inner layer engaging said inner surface of said outer layer and with said conical protuberances received within respective ones of said conical recesses.

2. The padding of claim 1, further including a comfort liner engaging said inner surface of said inner layer.

3. The padding of claim 1, wherein said inner layer has a density of 25 to 50 kg/m$^3$.

4. The padding of claim 3, wherein said outer layer has a density of 60 to 90 kg/m$^3$.

5. The padding of claim 2, wherein said comfort liner has an inner surface adapted to engage a user's head.

6. The padding of claim 1, engaged within the outer shell of a helmet.

7. The padding of claim 1, wherein each of said conical protuberances has a pointed end.

8. The padding of claim 7, wherein each of said pointed ends terminates at a location spaced from said outer surface of said outer layer.

9. The padding of claim 8, wherein said location is offset 1 to 5 millimeters from said outer surface of said outer layer.

10. The padding of claim 7, wherein each of said pointed ends is contiguous with said outer surface of said outer layer.

11. The padding of claim 1, wherein each of said conical protuberances has a circular base.

12. The padding of claim 1, wherein each of said conical protuberances has a width of approximately 18 to 22 millimeters.

13. The padding of claim 12, wherein each of said conical protuberances has a height of 20 to 25 millimeters.

14. The padding of claim 13, wherein adjacent conical protuberances are spaced apart by a distance of 0.5 to 5.0 millimeters.

15. The padding of claim 1, wherein said inner layer of foam padding and outer layer of foam padding both comprise polystyrene foam.

16. An improved helmet padding for engagement within the outer shell of a helmet, the helmet padding comprising:

a) an inner layer of foam padding including an inner surface and an outer surface, said outer surface defining a plurality of integrally formed conical protuberances, said inner layer of foam padding having a density of 25 to 50 kg/m$^3$;

b) an outer layer of foam padding having a density of 60 to 90 kg/m$^3$ and including an inner surface and an outer surface, said inner surface of said outer layer defining a plurality of conical recesses, each of said conical recesses sized to receive, with surface contact, one of said conical protuberances;

c) said inner and outer layers being assembled together with said outer surface of said inner layer engaging said inner surface of said outer layer and with said conical protuberances received within respective ones of said conical recesses; and d) a comfort liner engaging said inner surface of said inner layer, said comfort liner having an inner surface adapted to engage a user's head.

17. The padding of claim 16, engaged within the outer shell of a helmet.

18. The padding of claim 16, wherein each of said conical protuberances has a pointed end terminating at a location spaced from said outer surface of said outer layer.

19. The padding of claim 16, wherein each of said pointed ends is contiguous with said outer surface of said outer layer.

20. A protective helmet comprising:

a hard outer shell surrounding a multilayer foam padding structure, the multilayer foam padding structure including an inner foam layer disposed adjacent an outer foam layer;

wherein said inner foam layer includes an inner surface and an outer surface, said outer surface of said inner foam layer defining a plurality of integrally formed conical protuberances, and said inner foam layer having a density relatively lower than density of said outer foam layer;

wherein said outer foam layer includes an inner surface and an outer surface, said inner surface of said outer foam layer defining a plurality of conical recesses, each of said conical recesses sized to receive, with surface contact, one of said conical protuberances;

wherein said inner and outer foam layers are assembled together with said outer surface of said inner foam layer engaging said inner surface of said outer foam layer and with said protuberances received within respective ones of said recesses, and said outer surface of said outer foam layer engaging said hard outer shell.

21. The protective helmet of claim 20, further comprising:

a comfort liner engaging said inner surface of said inner foam layer.

22. The protective helmet of claim 20, wherein:

said inner foam layer has a density of 25 to 50 $kg/m^3$; and said outer foam layer has a density of 60 to 90 $kg/m^3$.

23. The protective helmet of claim 20, wherein:

each of said conical protuberances has a pointed end.

24. The protective helmet of claim 23, wherein:

said pointed end of each conical protuberance terminates at a location spaced from said outer surface of said outer foam layer.

25. The protective helmet of claim 23, wherein:

said pointed end of each conical protuberance is contiguous with said outer surface of said outer foam layer.

26. The protective helmet of claim 20, wherein:

each conical protuberance has a circular base.

27. The protective helmet of claim 20, wherein:

said inner foam layer and said outer foam layer of said multilayer foam padding structure are realized from polystyrene foam.

* * * * *